US008355641B2

(12) United States Patent
Adachi et al.

(10) Patent No.: US 8,355,641 B2
(45) Date of Patent: Jan. 15, 2013

(54) PAPER WRINKLE SIGN MONITORING DEVICE, PAPER WRINKLE SIGN MONITORING METHOD, AND COMPUTER READABLE MEDIUM

(75) Inventors: Koji Adachi, Kanagawa (JP); Kaoru Yasukawa, Kanagawa (JP); Shigehiro Furukawa, Kanagawa (JP); Norikazu Yamada, Kanagawa (JP); Koki Uwatoko, Kanagawa (JP); Tetsuichi Satonaga, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 509 days.

(21) Appl. No.: 12/422,510

(22) Filed: Apr. 13, 2009

(65) Prior Publication Data

US 2010/0135680 A1 Jun. 3, 2010

(30) Foreign Application Priority Data

Dec. 3, 2008 (JP) ..... 2008-309134

(51) Int. Cl.
*G03G 15/00* (2006.01)
*G03G 15/20* (2006.01)

(52) U.S. Cl. ..... 399/18; 399/33

(58) Field of Classification Search ..... 399/18, 399/33

See application file for complete search history.

(56) References Cited

U.S. PATENT DOCUMENTS

| | | | | |
|---|---|---|---|---|
| 5,406,362 | A * | 4/1995 | Mills | 399/126 |
| 2003/0062671 | A1 * | 4/2003 | Yasui et al. | 271/270 |
| 2005/0286916 | A1 | 12/2005 | Nakazato et al. | |
| 2007/0113692 | A1 * | 5/2007 | Yasukawa et al. | 73/865.9 |

FOREIGN PATENT DOCUMENTS

| | | |
|---|---|---|
| JP | A-5-24713 | 2/1993 |
| JP | A-06-183602 | 7/1994 |
| JP | A-9-269697 | 10/1997 |
| JP | A-2001-117416 | 4/2001 |
| JP | A-2003-137478 | 5/2003 |
| JP | A-2004-117800 | 4/2004 |
| JP | A-2006-11174 | 1/2006 |
| JP | A-2006-21905 | 1/2006 |
| JP | A-2007-47555 | 2/2007 |
| JP | A-2007-210718 | 8/2007 |
| JP | A-2008-83091 | 4/2008 |

OTHER PUBLICATIONS

Notification of Reason for Refusal for corresponding Japanese Patent Application No. 2008-309134, mailed on Nov. 2, 2010 (w/ English translation).

Office Action issued in Japanese Application No. 2008-309134 dated May 31, 2011 (with translation).

Office Action issued in Japanese Patent Application No. 2008-309134 dated Feb. 8, 2011 (With Translation).

* cited by examiner

*Primary Examiner* — Judy Nguyen
*Assistant Examiner* — Blake A Tankersley
(74) *Attorney, Agent, or Firm* — Oliff & Berridge, PLC

(57) ABSTRACT

A paper wrinkle sign monitoring device includes: at least one timing detecting unit that is set on a transport path of a printing medium, and that detects transport timing of the printing medium; and a sign output unit that detects a sign of paper wrinkle generation in the transporting time of the printing medium based on the transport timing of the printing medium detected by the timing detecting unit, and that outputs the sign.

18 Claims, 10 Drawing Sheets

PAPER WRINKLE SIGN MONITORING DEVICE, PAPER WRINKLE SIGN MONITORING METHOD, AND COMPUTER READABLE MEDIUM

CROSS-REFERENCE TO RELATED APPLICATIONS

This application is based on and claims priority under 35 U.S.C. 119 from Japanese Patent Application No. 2008-309134 filed Dec. 3, 2008.

BACKGROUND

1. Technical Field

The present invention relates to a paper wrinkle sign monitoring device, a paper wrinkle sign monitoring method, and a computer readable medium.

2. Related Art

Conventionally, there have been known technologies for detecting generation of paper wrinkle which occurs in a fuser unit in an electro-photographic imaging apparatus and for monitoring a sign of paper wrinkle generation.

SUMMARY

According to an aspect of the present invention, a paper wrinkle sign monitoring device includes: at least one timing detecting unit that is set on a transport path of a printing medium, and that detects transport timing of the printing medium; and a sign output unit that detects a sign of paper wrinkle generation in the transporting time of the printing medium based on the transport timing of the printing medium detected by the timing detecting unit, and that outputs the sign.

BRIEF DESCRIPTION OF THE DRAWINGS

Exemplary embodiment of the present invention will be described in detail based on the following figures, wherein.

DETAILED DESCRIPTION (First Embodiment)

Figure 1:
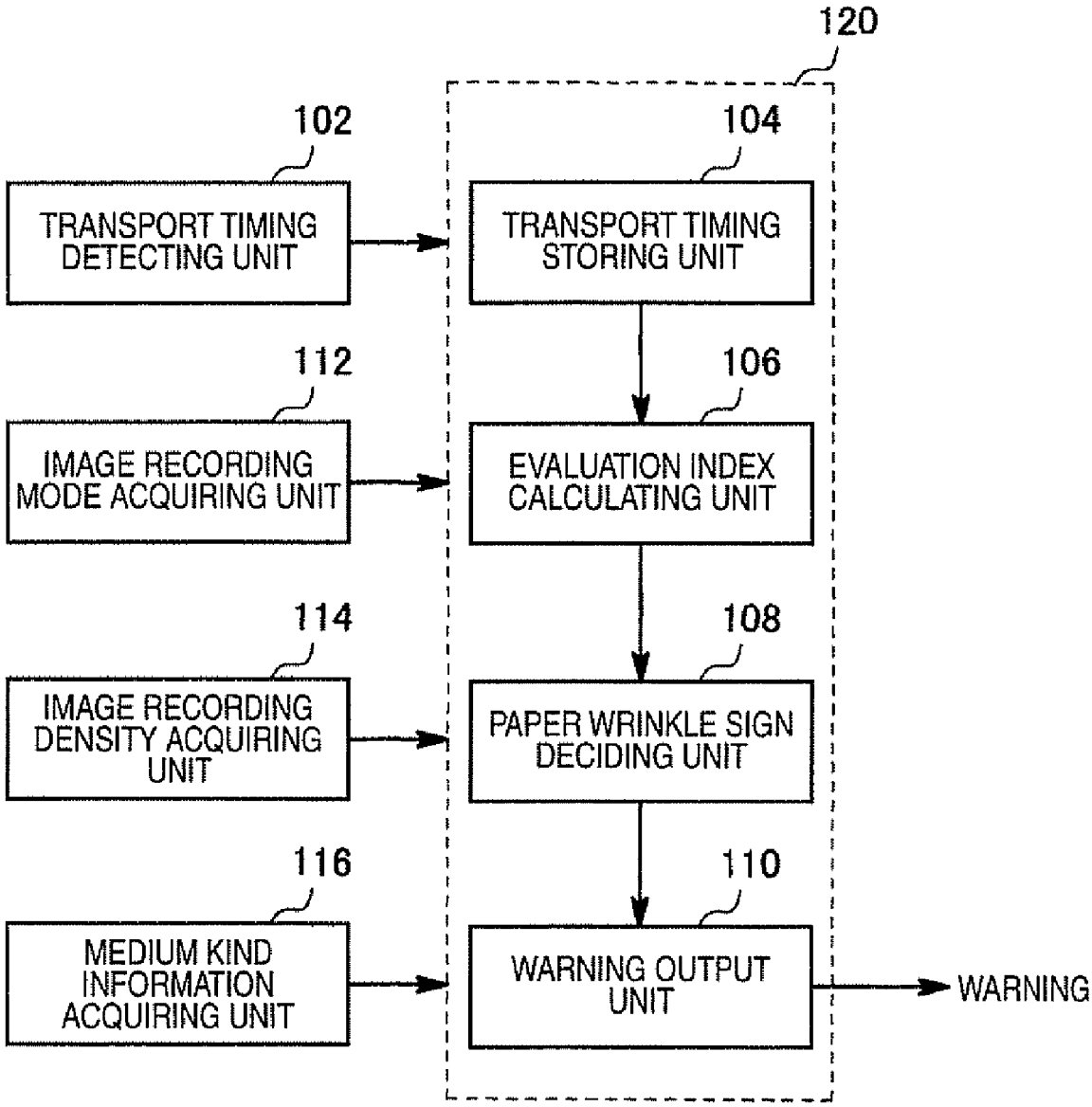
FIG. 1 is a diagram showing the constitution of a paper wrinkle sign monitoring device in an embodiment of the invention.

A paper wrinkle sign monitoring device 100 in a first embodiment, as shown in a functional block diagram of FIG. 1, includes a transport timing detecting unit 102, a transport timing storing unit 104, an evaluation index calculating unit 106, a paper wrinkle sign deciding unit 108, a warning output unit 110, an image recording mode acquiring unit 112, an image recording density acquiring unit 114, and a medium kind information acquiring unit 116.

The transport timing storing unit 104, the evaluation index calculating unit 106, the paper wrinkle sign deciding unit 108, and the warning output unit 110 constitute a sign output unit 120 which detects a sign of paper wrinkle and outputs warning.

In the paper wrinkle sign monitoring device 100, the transport timing detecting unit 102, the transport timing storing unit 104, the evaluation index calculating unit 106, the paper wrinkle sign deciding unit 108, the warning output unit 110, the image recording mode acquiring unit 112, the image recording density acquiring unit 114, and the medium kind information acquiring unit 116 are realized by a computer.

Figure 2:
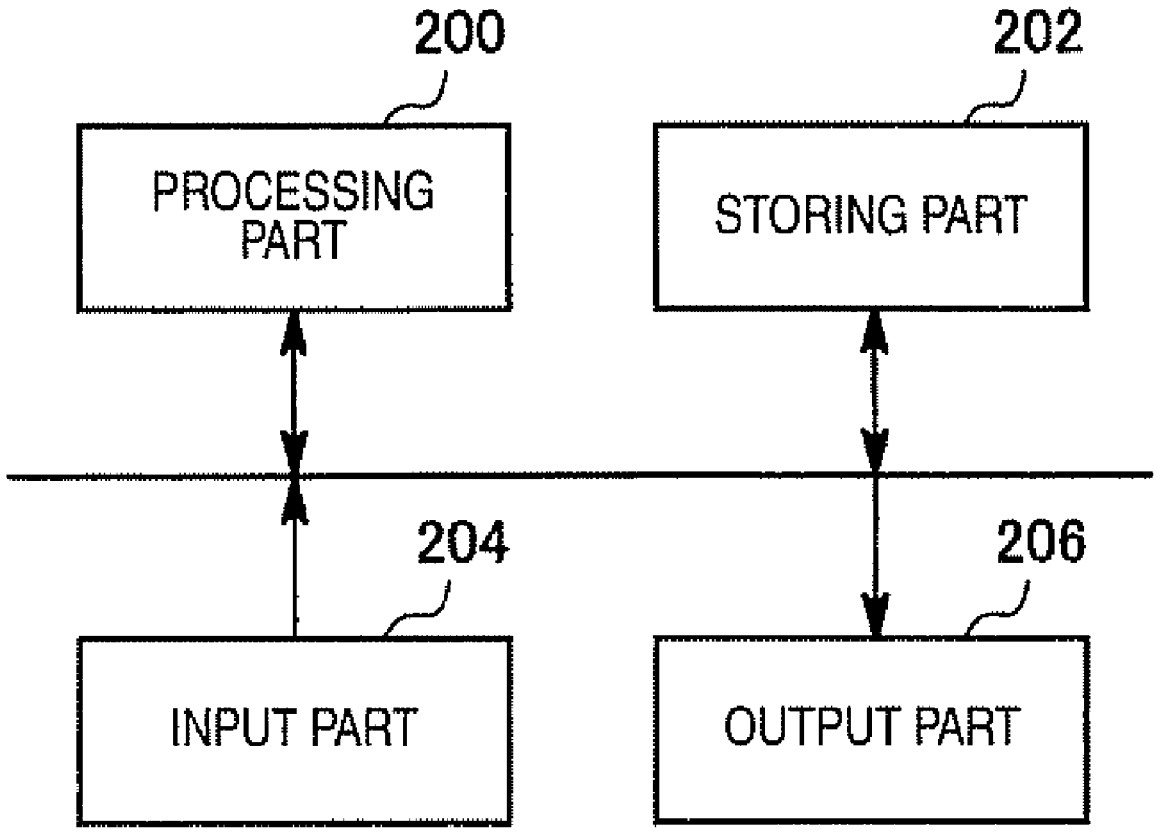
FIG. 2 is a diagram showing the constitution of a computer which realizes the paper wrinkle sign monitoring device in the embodiment of the invention.

The computer realizing the paper wrinkle sign monitoring device 100 includes, as shown in FIG. 2, a processing part 200, a storing part 202, an input part 204, and an output part 206.

The processing part 200 is generally a CPU of the computer, which executes an image forming program and a paper wrinkle sign monitoring program, and controls integratively each part of an image forming apparatus including the paper wrinkle sign monitoring device 100.

The storing part 202 stores and retains the paper wrinkle sign monitoring program executed by the paper wrinkle sign monitoring device 100, and various parameters and various data utilized in processing of its program. The storing part 202 is appropriately accessed from the processing part 200. The storing part 202 includes a memory unit such as a semiconductor memory or a hard disc.

The input part 204 acquires the various parameters and various data used in the paper wrinkle sign monitoring device 100. The input part 204 may include a touch panel which accepts an instruction from a user and input of the various parameters or the various data. Further, the input part 204 may include an interface which samples, in the transport timing detecting unit 102, the outputs from a sensor that detects a printing medium transported on a transport path; an interface which acquires, in the image recording mode acquiring unit 112, information on the image recording mode; an interface which acquires, in the image recording density acquiring unit 114, information on recording density of an image to be formed onto a printing medium; and an interface which acquires, in the medium kind information acquiring unit 116, information on the kind of printing medium.

The output part 206 displays an interface screen for inputting the various parameters and various data to be used in the paper wrinkle sign monitoring device 100, and a processing result obtained by the paper wrinkle sign monitoring device 100. The output part 206 may include a touch panel having a display function, such as a liquid crystal panel.

Figure 3:
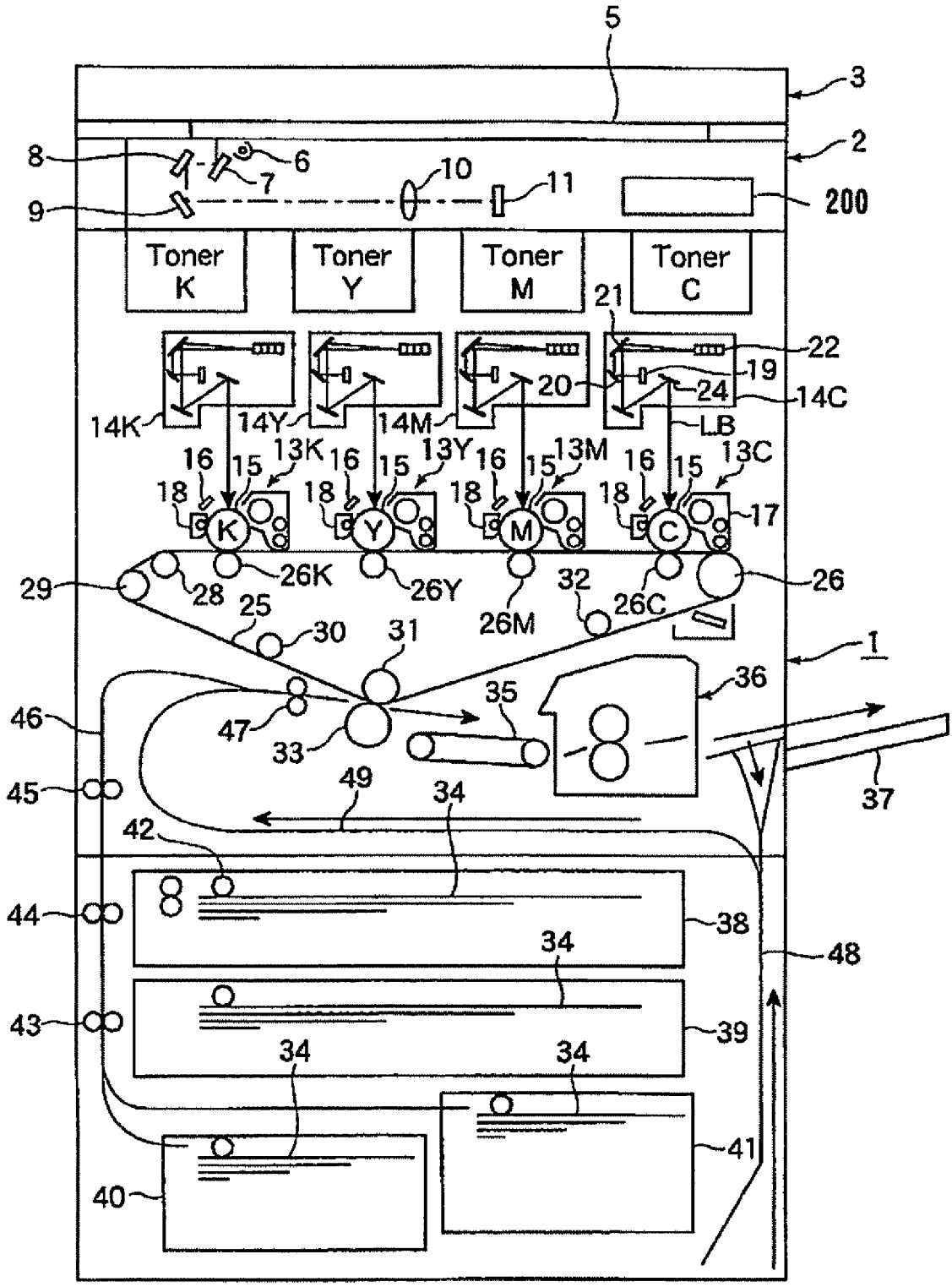
FIG. 3 is a diagram showing the constitution of an image forming apparatus to which a paper wrinkle sign monitoring device in the embodiment of the invention is applied.

FIG. 3 is a constitutional example of an image forming apparatus 300 having the paper wrinkle sign monitoring device 100 in the first embodiment. In the embodiment, as an example of the image forming apparatus 300, an electro-photographic printing apparatus is described.

The image forming apparatus 300 in FIG. 3 shows an example of image forming apparatuses utilizing an optical scanning device (raster output scan: ROS). Herein, a so-called tandem typed image forming apparatus is shown, in which four image forming sections are provided so as to correspond to each color of K (black), Y (yellow) M (magenta), and C (cyan).

An original image reading section 2 includes an original document cover 3, a platen 5, a light 6, mirrors 7 and 8, a lens 10, and an optical/electrical conversion element 11. In the original image reading section 2, an original document placed on the platen 5 is irradiated with the light 6 and scanned, and an original image is converted into electrical signals by the optical/electrical conversion element 11 by means of the mirrors 7, 8 and the lens 10. Hereby, the original image is read from the original document. The read original image is transmitted to the processing part 200, digitalized, and stored in the storing part as original image data. Further, the original image data may be received, by means of a data interface, through a network from an external computer. For example, it is also suitable that the processing part 200 is combined with a computer that is a transmitting end of the original image data. The received original image data is temporarily stored in the storing part 202 which is accessible from the processing part 200.

The image forming section 1 has optical scanning devices 14K, 14Y, 14M and 14C for respective colors of black (K), yellow (Y), magenta (M) and cyan (C). Each optical scanning device includes a semiconductor laser 22, and mirrors 19, 20, 21 and 24 which reflect a laser beam emitted from the semiconductor laser 22 toward a photoreceptor drum 15 that is an example of a photoconductive material. Further, the image forming section 1 includes image forming sections 13K, 13Y, 13M and 13C for the respective colors of K, Y, M and C, which are spaced side-by-side in one direction; an intermediate transfer belt 25 which constitutes an intermediate transfer part; belt rollers 27 to 31; and a fuser unit 36. Further, in order to transport printing mediums (recording paper) 34 from paper supply trays 38 to 41 to the intermediate transfer belt 25, a pick-up roll 42 and plural transport roll pairs 43 to 47 are provided, as roll members, on a paper transport path.

For example, in the image forming section for K-color, firstly, the optical scanning device 14K is driven by a black image forming signal from the processing part 200, and converts the black image forming signal into an optical signal by the semiconductor laser 22. The laser beams are scanned, on the basis of the converted signal, on the photoreceptor drum 15K charged by a charger 16K, thereby to form on the photoreceptor drum 15K an electrostatic latent image corresponding to a black component of the original image. This electrostatic latent image is formed into a toner image by a development unit 17K to which black toner is supplied. This toner image, while the intermediate transfer belt 25 passes through the photoreceptor drum 15K, is transferred onto the intermediate transfer belt 25 by a primary transfer roll 26K. After the transferring step, the toner remaining on the photoreceptor drum 15K is removed by a cleaner 18K.

Similarly, by image forming signals of other colors Y, M and C than the K-color, electrostatic latent images are formed on photoreceptor drums 15Y, 15M and 15C, and the respective electrostatic latent images are formed into toner images by development units 17Y, 17M and 17C to which the respective color toners are supplied. The respective toner images, while the intermediate transfer belt 25 passes through the corresponding photoreceptor drums 15Y, 15M and 15C, are transferred in order onto the intermediate transfer belt 25 by corresponding primary transfer rolls 26Y, 26M and 26C.

The toner on the intermediate transfer belt 25 on which the toner images of the K, Y, M and C-colors have been multi-layer-transferred is separated from the intermediate transfer belt 25 by a secondary transfer roll 33, and transferred onto a printing medium (recording paper) 34 transported on the transport path. The printing medium 34 is transported to the fuser unit 36, and the toner is fixed onto the printing medium 34 by the fuser unit 36.

The printing medium 34 on which the image has been thus formed is output from the copying machine. On the downstream side of the fuser unit 36, there are provided a exit path for transporting the paper to the outside of the machine, and a paper exit tray 37 for receiving, on the outside of the machine, the printing medium 34 on which the image has been formed.

Further, on the transport path, there is provided a sensor for detecting a transport condition of the printing medium 34. Generally, many jam detecting sensors are provided in order to detect generation of a paper jam state where the printing mediums 34 are jammed on the transport path. The sensor may be, for example, an optical timing sensor. Each sensor is connected to the input part 204 which is accessible from the processing part 200. In order to avoid the complicated figure, the sensors are not shown in FIG. 3.

Figure 4:
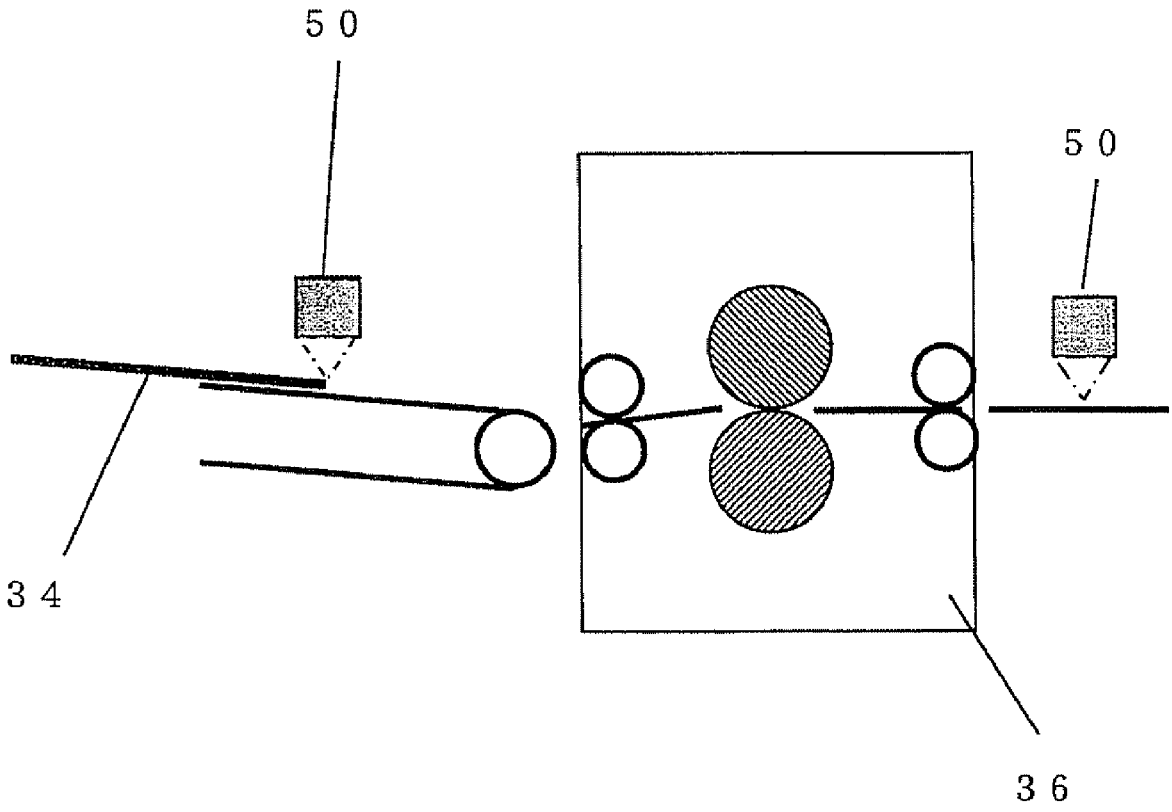
FIG. 4 is a diagram showing the layout of sensors in the embodiment of the invention.

In the embodiment, as shown in FIG. 4, the sensors 50 are provided at least in front and rear of the fuser unit 36. The sensor 50, which is, for example, a reflection type optical sensor, is set in the center of the transport path. The outputs from these sensors 50 are periodically sampled through the input part 204 by the processing part 200, and the sensors 50 detect a passage timing of a leading edge of the printing medium 34 within an error range of a sampling cycle.

Figure 5:
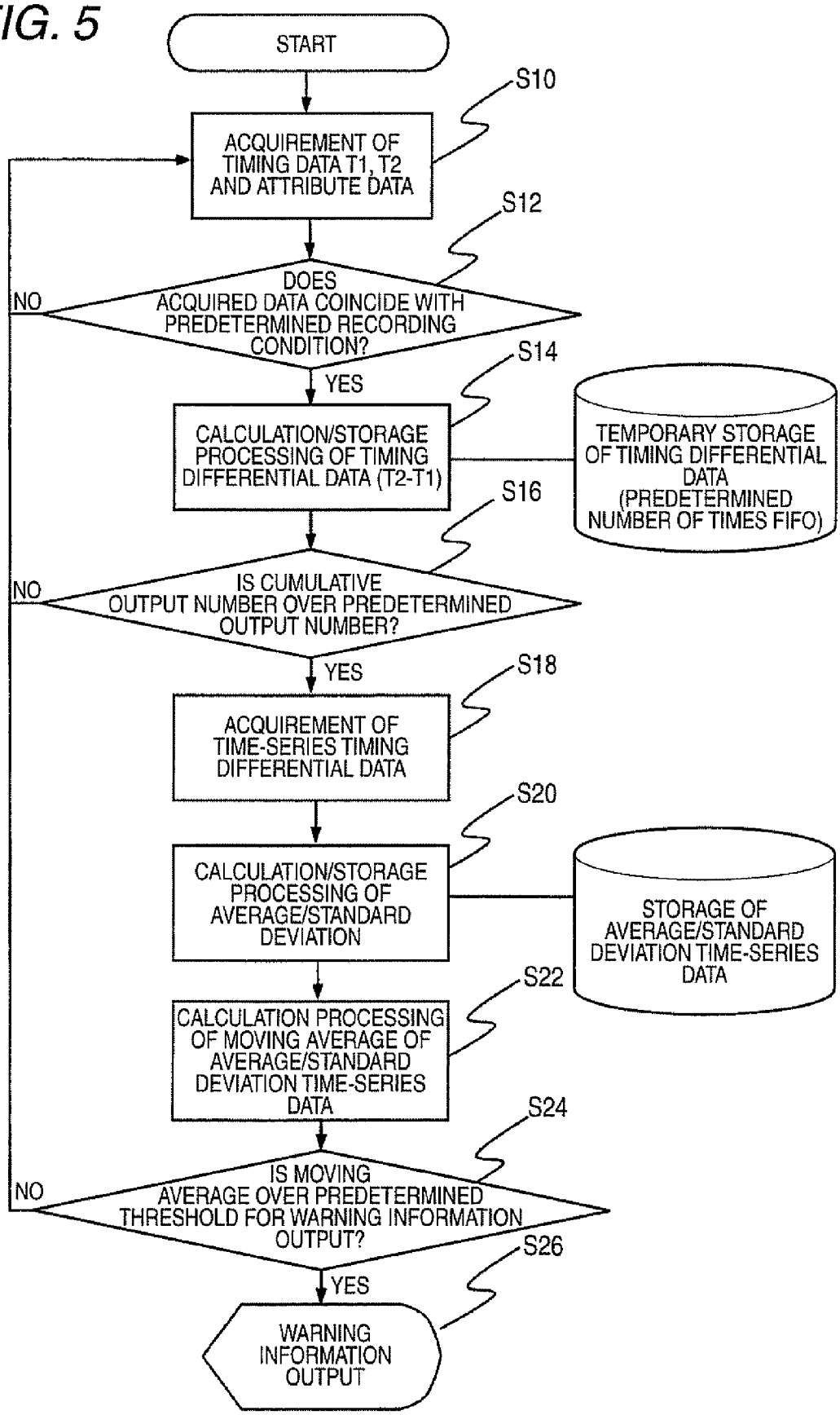
FIG. 5 is a flowchart showing paper wrinkle sign monitoring processing in the embodiment of the invention.

Paper wrinkle sign monitoring processing in the image forming apparatus 300 having the thus constructed paper wrinkle sign monitoring device 100 will be described below. The paper wrinkle sign monitoring processing is performed by making the processing part 200 execute the paper wrinkle sign monitoring program previously stored in the storing part 202. The paper wrinkle sign monitoring processing is executed in accordance with a flowchart of FIG. 5.

In a step S10, transport timing of the printing medium 34 is detected. This processing corresponds to the transport timing detecting unit 102.

The processing part 200 samples periodically the output signals from the sensors 50 set in front and rear of the fuser unit through the input part 204. The processing part 200 acquires, from timed changes of the sampled output signals from the sensors 50, timing data (t1, t2) in which the leading edge of the printing medium 34 passes through the positions in which the sensors 50 set in front and rear of the fuser unit are located.

Further, in the step S10, attribute data regarding image recording, including an image recording mode, an image recording density, the kind of paper is acquired. These processing correspond to the image recording mode acquiring unit 112, the image recording density acquiring unit 114 and the medium kind information acquiring unit 116.

The image recording mode acquiring unit 112 is realized by acquiring, in the processing part 200, a recording mode in which the image forming apparatus 300 operates, from operation input information of the input part 204 such as a touch panel and print jog information.

Since a process speed in the image forming apparatus 300 varies according to image recording modes, the transport timing of the printing medium 34 on the transport part changes. In the image forming apparatus 300 constituted so that the image recording speed varies according to image recording modes such as color recording/monochrome recording, manual feed/tray feed, and thick paper/thin paper, the transport speed of the printing medium 34 is different among the respective image recording modes. Further, also regarding a recording mode of one-sided recording/two-sided recording, the passage time of the printing medium 34 at the fuser unit 36 is different between a case where the printing medium 34 passes through the fuser unit 36 one time and a case where the printing medium 34 passes through the fuser unit 36 two times.

The image recording density acquiring unit 114 is realized by processing, in the processing part 200, the image data formed in the image forming apparatus 300. The image recording density information is calculated for each page of the image data processed in the processing part 200. The image recording density is obtained by dividing the total number of pixels of recorded images of the respective colors formed on one page of the printing medium 34 by the number of all pixels of its printing medium 34. The image recording density is generally referred to as coverage. Further, in case of the above two-sided recording mode, the average of the image recording densities on the both sides may be taken as image recording density of its printing medium 34. Further, in case that the surface property on the printing medium 34 is different between the toners forming the Y, M and C-color images and the toner forming the K-color image, the densities of the Y, M, C-color images may be multiplied by a correction factor and thereafter their densities and the density of the K-color image may be added up.

The medium kind information acquiring unit 116 is realized by obtaining, in the processing part 200, the kind of the printing medium 34 on which an image is to be formed in the image forming apparatus 300. The processing part 200 acquires, by input from a user through the input part 204, the kind of the printing medium 34, use of medium back side, the size of the medium 34, and the like. The size may be acquired from the tray information of the image forming apparatus 300. Further, in case of print processing, the kind of the printing medium 34, use of medium back side, the size of the medium 34, and the like which are included in print job information that is a subject of processing may be acquired. However, regarding the use of medium back side, since the image recording density of a back-sided image becomes unfixed, the back side of the medium is not used in paper wrinkle sign monitoring.

Though the image recording mode acquiring unit 112, the image recording density acquiring unit 114 and the medium kind information acquiring unit 116 are used in order to monitor the paper wrinkle sign with high accuracy, it is not necessary to use always all the information. In the following description, whether a sign of paper wrinkle generation is monitored or not is decided on the basis of the attribute data including the image recording mode, the image recording density and the medium kind, but the sign of paper wrinkle generation may be monitored without depending on the image recording mode, the image recording density and the medium kind, or the sign of paper wrinkle generation may be monitored on the basis of at least one of the image recording mode, the image recording density and the medium kind.

Further, in order to monitor the sign with higher accuracy, an image recording mode, an image recording density, and a printing medium 34 may be previously set as a test mode, and the timing measurement may be executed in an image forming state in the test mode.

In a step S12, whether or not the attribute data including the image recording mode, the image recording density and the medium kind, which have been acquired in the step S10, coincides with the preset image forming conditions for sign monitoring is decided. In case that the attribute data including the image recording mode, the image recording density and the medium kind coincides with the image forming conditions for sign monitoring, the processing part 200 proceeds to a step S14; and in case that the attribute data does not coincides with the image forming conditions, the processing part 200 returns to the step S10, and acquires timing data and attribute data for next image formation.

Regarding the condition of the image recording density, the sliding amount of the printing medium 34 on the transport path becomes larger in case of higher image recording density. Therefore, in this case, a difference in passage timing between the normal time and the paper wrinkle generating time become larger. Namely, in case of higher image recording density, prediction performance of the paper wrinkle generation becomes higher. Accordingly, it is better that image recording density as the image formation condition is set in consideration of the image recording density that is high in usage frequency in the image forming apparatus 300 and the prediction performance of the paper wrinkle generation.

Further, regarding the condition of the medium kind, it is better that the kind of printing medium 34 that is high in usage frequency in the image forming apparatus 300 is set. Further, in order to improve the sign monitoring accuracy, plural conditions may be set as the image recording density and the medium kind.

Further, it is better that the image recording density in a test chart in case of evaluation in the test mode is set, in consideration of a load onto the image forming apparatus 300 and the prediction performance of the paper wrinkle generation, to the image recording density of about 50% of a maximum image recording density, for example, to the image recording density of more than 30% and less than 70% of the maximum image recording density. Further, it is better that the medium kind is set to a value of basis weight of paper classified as thin paper on the basis of the standard paper, for example, a value less than basis weight of 100 g/m$^2$.

In a step S14, a difference of timing data between the two sensors 50 acquired in the step S10 is obtained. The processing part 200 calculates a difference of timing (t1, t2) acquired in the step S10 at which the leading edge of the printing medium 34 passes, and stores the calculated difference in the storage area of the storing part 202. This processing corresponds to the transport timing storing unit 104.

Herein, the passage timing (t1, t2) at which the leading edges of the preset number of printing mediums 34 for the preset image recording density and medium kind pass in front and rear of the fuser unit are stored in the recording part 202. The preset number is, for example, 100 sheets. The storing part 202 stores the information of the preset number of sheets, and outputs the stored information in accordance with a request of transport timing acquirement from the evaluation index calculating unit 106 in a succeeding stage. Further, in case that the stored information exceeds the information of the preset number of sheets, the information are successively overwritten in old order.

The storage area (D1) is so constituted as to be capable of storing the timing data (t1, t2) at the image formation time of 100 sheets, the differences of timing data (t1, t2) in this case, and the attribute data, and so constituted that the data are successively overwritten in old order in case that the stored data exceeds the data of 100 sheets.

In a step S16, the cumulative output number on image formation by the image forming apparatus 300 is acquired, and whether or not the acquired cumulative output number is monitoring timing of passage timing for the purpose of the preset sign monitoring processing is decided. The processing part 200, in case that the cumulative output number comes to the preset output number of sheets in the preset sign monitoring execution, proceeds to a step S18; and in case that the cumulative output number does not come to the preset output number, returns to the step S10. The monitoring timing may be performed every image recording output of 1000 sheets.

In the step S18, time-series timing differential data corresponding to the preset image recording number is read from the storage area D1. This processing corresponds to a part of the evaluation index calculating unit 106.

In a step 20, the average of the time-series timing differential data read in the step S18 is calculated. This processing corresponds to a part of the evaluation index calculating unit 106. The processing part 200 calculates the average of the time-series timing differential data read in the step S18, and stores the calculated value in an average time-series data storing area D2 of the storing part 202.

In a step S22, variations of the average are averaged. The processing part 200 reads out the average values of the preset calculation number from the average time-series data storing area D2, and calculates a moving average of their values.

Figure 6:
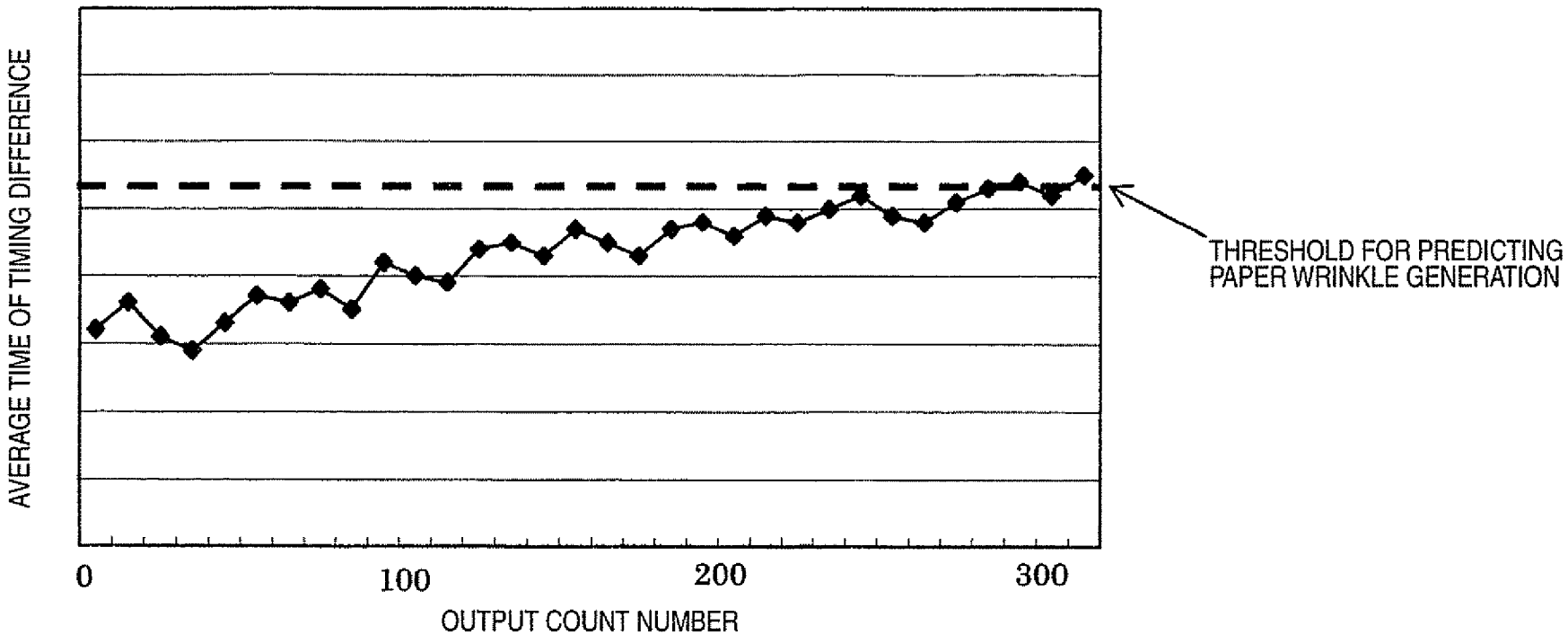
FIG. 6 is a diagram for explaining decision of a paper wrinkle generation sign.

In a step S24, a sign of paper wrinkle generation is decided from the moving average obtained in the step S22. This processing corresponds to the paper wrinkle sign deciding unit 108. The processing part 200 decides whether the moving average obtained in the step S22 exceeds a preset warning reference value for sign monitoring. In the embodiment, as shown in FIG. 6, the decision of the paper wrinkle generation sign is performed ever time the moving average is calculated. The processing part 200, in case that the moving average does not exceed the warning reference value, returns to the step S10; and in case that the moving average exceeds the warning reference value, proceeds to a step S26.

Further, as the warning reference value, plural thresholds may be used. In this case, the processing part 200 decides the signs of the plural levels according to which of the plural thresholds the moving average exceeds. For example, in order to seize the condition of stepwise deterioration, thresholds indicating a level requiring advance preparation for exchanging the fuser unit 36 and a level requiring immediate maintenance service may be set.

In the step S26, a warning against a sign of paper wrinkle generation is outputted. This processing corresponds to the warning output unit 110. The processing part 200, in accordance with the paper wrinkle sign deciding result obtained in the step S24, displays warning information, for example, on a screen of the output part 206 such as a touch panel. Alternatively, the processing part 200 may output the warning through the network connected to the output part 206 to a remote center as a base of remote maintenance service. To the remote center, together with the warning information, identification data capable of specifying the image forming apparatus 300 may be transmitted.

Figure 7:
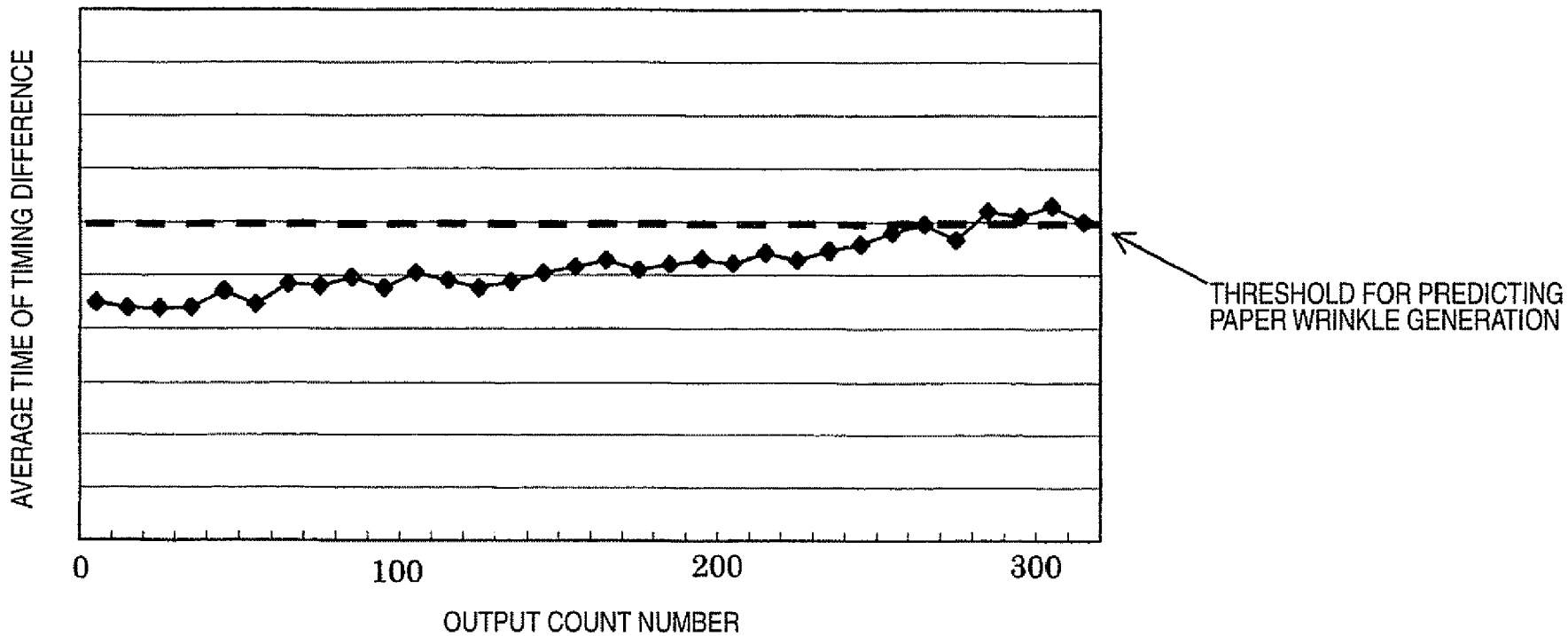
FIG. 7 is a diagram for explaining decision of a paper wrinkle generation sign.

In the step S20, the average value of the time-series timing differential data read in the step S18 was calculated, and the paper wrinkle sign was predicted on the basis of the obtained average. However, in the step S20, as shown in FIG. 7, a standard deviation of the time-series timing differential data read in the step S18 may be calculated thereby to predict the paper wrinkle sign on the basis of its standard deviation.

In this case, in the step S22, variations of the standard deviation are averaged. The processing part 200 reads out the standard deviations of the preset calculation number from the average time-series data storing area D2, and calculates a moving average of their values. The processing in steps S24 and S26 in this case may be the same as the processing in the above steps S24 and S26.

Further, the decision of the paper wrinkle generation sign may be performed, using both of the average and the standard deviation. In this case, it is better that the decision of the paper wrinkle generation sign is performed on the basis of a case that the average and the standard deviation exceed thresholds set respectively for them, or on the basis of a case that either of them exceeds its threshold.

Further, the decision may be executed for two-dimensional canonical space including the average and the standard deviation. Regarding the two-dimensional canonical space, it is better that a discrimination analysis such as Mahalanobis' distance discrimination or linear discrimination is utilized.

Figure 8:
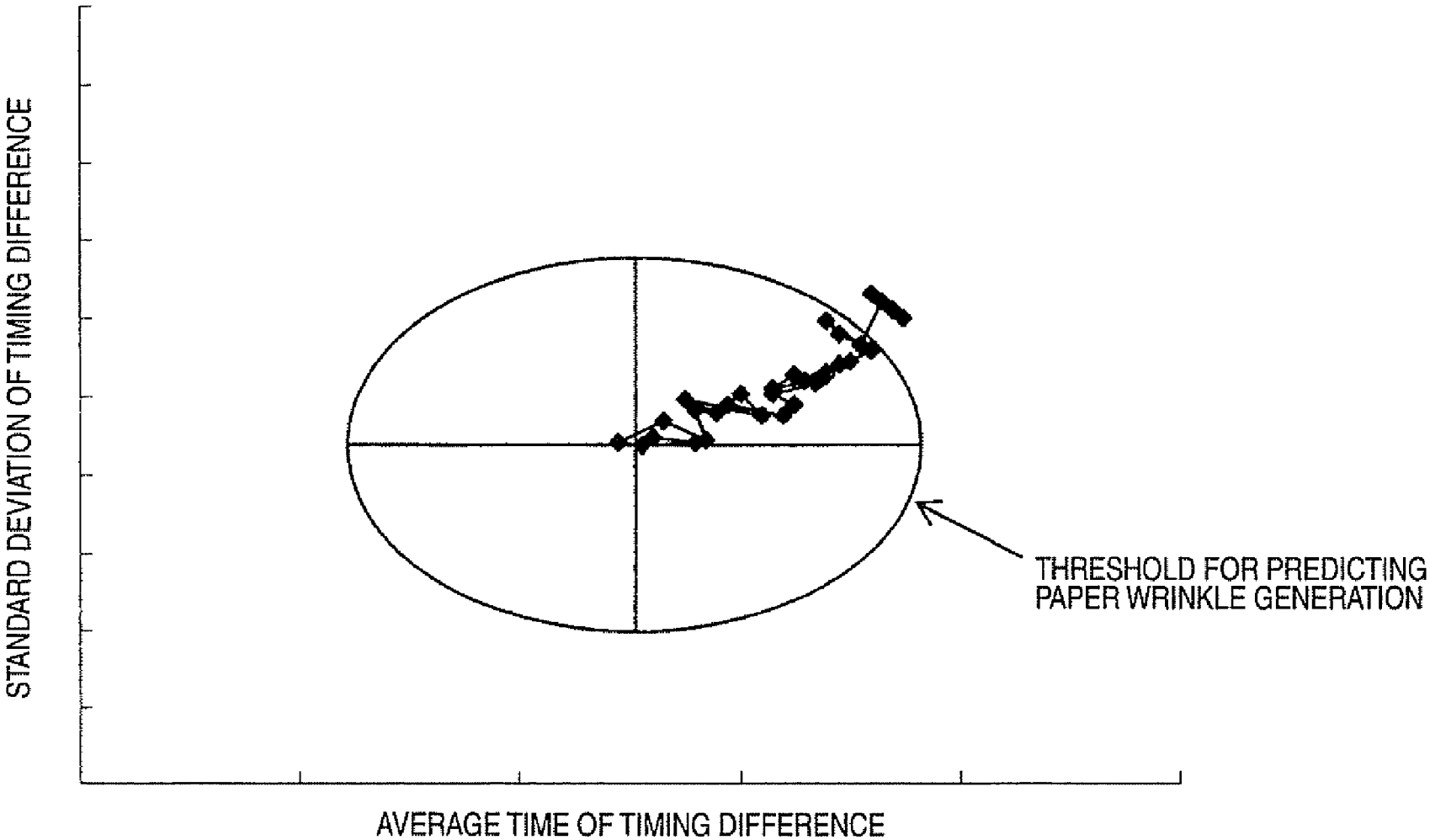
FIG. 8 is a diagram for explaining decision of a paper wrinkle generation sign.

FIG. 8 shows a sign deciding method in the two-dimensional Mahalanobis' canonical space including the average and the standard deviation. In the Mahalanobis distance discrimination, in case that passage timing in an initial state at the fuser unit 36 in the image forming apparatus 300 satisfies a condition, the average value and the standard deviation are sampled plural times in advance. Then, canonical space of their sampling values is calculated, and by whether a difference in distance between each sampling value and a center point exceeds a preset threshold, the paper wrinkle generation sign is decided.

The Mahalanobis distance $D_M$ from a group of values with mean $\mu=(\mu_1, \mu_2, \ldots \mu_p)^T$ and covariance matrix $\Sigma$ (matrix in which covariances between variables are arranged) for a multivariate vector $x=(x_1, x_2, \ldots x_p)^T$ is calculated by a numerical expression (1).

$$D_M(X)=((x-\mu)^T\Sigma^{-1}(x-\mu))^{1/2} \quad (1)$$

(Second Embodiment)

Figure 9:
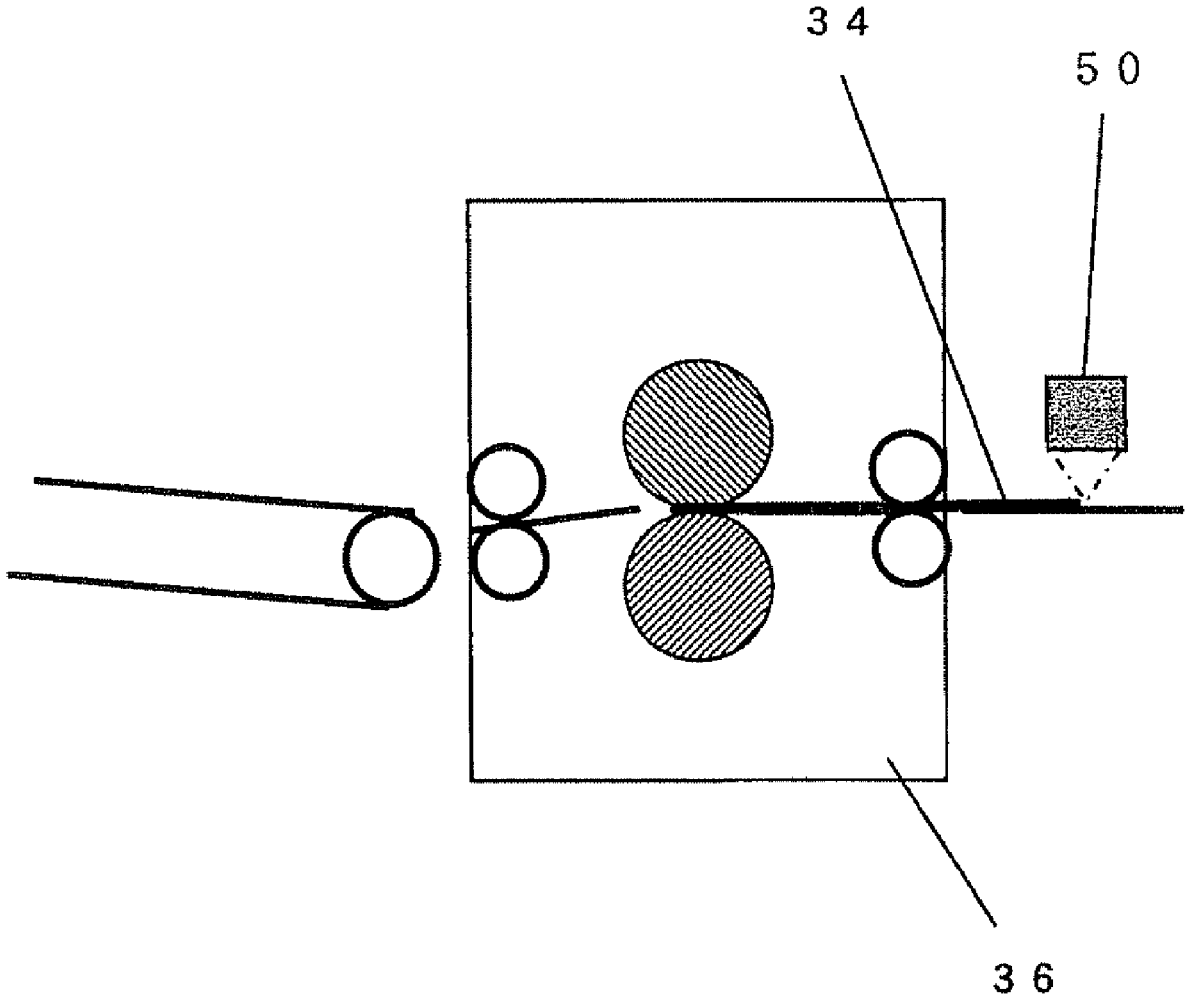
FIG. 9 is a diagram showing the layout of a sensor in another embodiment of the invention.

In a paper wrinkle sign monitoring device 100 in a second embodiment, as shown in FIG. 9, a sensor 50 of a transport timing detecting unit 102 is set at the rear of a fuser unit. A processing part 200 samples output signals from the sensor 50 and detects passage timing (t1, t2) of a leading edge and a rear edge of a printing medium 34. The subsequent processing is performed similarly to the processing in the first embodiment.

(Third Embodiment)

Figure 10:
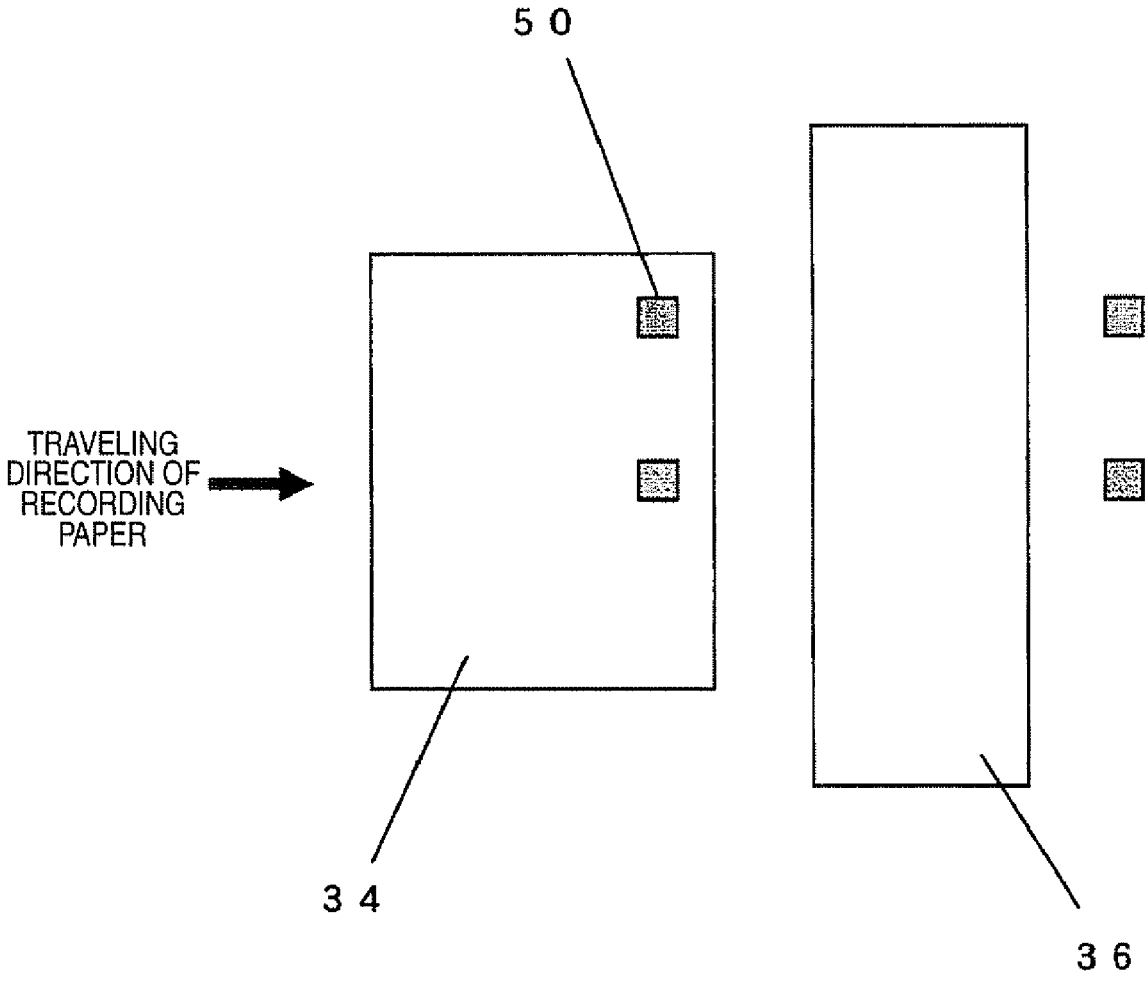
FIG. 10 is a diagram showing arrangement of sensors in another embodiment of the invention.

In a paper wrinkle sign monitoring device 100 in a third embodiment, as in the first embodiment, sensors 50 are set in front and rear of a fuser unit 36 and in center positions where a center portion of a printing medium 34 passes, and also set, as shown in FIG. 10, in edge positions where an edge portion of the printing medium 34 passes. FIG. 10 shows the layout of the sensors 50 in case that an image forming apparatus 300 is seen from a top surface. These sensors 50 are used in order to obtain a skew angle when the printing medium 34 passes on a transport path.

In transport timing detection, passage timing of a leading edge of the printing medium 34 are detected by the sensors 50 set in front and rear of the fuser unit 36. Further, a difference between timing at which the leading edge of the printing medium 34 is detected by the sensor 50 set in the center position and the sensor 50 set in the edge position is detected as the skew amount of the printing medium 34 in relation to the transport path.

For example, in an image forming apparatus 300 having a process speed of 200 mm/sec., in case that a distance between the sensor 50 set in the center position and the sensor 50 set in the edge position is 150 mm, the skew amount of 0.1° corresponds to a difference of about 1.3 msec. as a difference in detection time between the sensor 50 set in the center position and the sensor 50 set in the edge position.

In the third embodiment, using the thus obtained skew amount in place of the difference in transport timing, a sign of paper wrinkle generation is decided. Namely, in a step S18, at least one of the average and standard deviation of the skew amount obtained in time series is calculated and stored. In a step S22, the moving average of at least one of the average and standard deviation of the skew amounts is obtained. In a step S24, on the basis of at least one of the moving average of the average of the skew amount and the moving average of the standard deviation of the skew amount, which was obtained in the step S22, a sign of paper wrinkle generation is decided. Namely, in case that at least one of the moving average of the average of the skew amount and the moving average of the standard deviation of the skew amount exceeds a preset threshold for its moving average, it is decided that there is a sign of paper wrinkle generation, and warning is outputted in a step S26.

Further, in addition to the average of the skew amount or the standard deviation of the skew amount, in combination with the average of transport timing of the printing medium 34 or the standard deviation thereof, a sign of paper wrinkle generation may be decided. Namely, by combining the average of the skew amount or the standard deviation thereof, and the average of transport timing of the printing medium 34 or the standard deviation thereof, in case that at least one or plural values of them exceeds the threshold for paper wrinkle decision, a warning may be outputted.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A paper wrinkle sign monitoring device comprising:

an information acquiring unit that acquires printing conditions of printing media;

at least one timing detecting unit that is set on a transport path of the printing media, and that detects transporting times which are an amount of time it takes for the respective print media to be transported a specified distance; and a sign output unit that determines a sign of paper wrinkle generation in the transporting times of the printing media and outputs a notification of the sign, wherein:

the determination of the sign of paper wrinkle generation is based on at least one of an average and a standard deviation of the transporting times of the printing media detected by the at least one timing detecting unit, the at least one of the average and the standard deviation is calculated only from the transporting times of printing media which have a printing condition that coincides with a predetermined recording condition, the at least one of the average and the standard deviation is determined based upon a first predetermined number of detected transporting times, and the detected transporting times are stored in a storage unit that overwrites an oldest stored detected transporting time when a number of stored detected transporting times exceeds the first predetermined number of detected transporting times.

2. The paper wrinkle sign monitoring device as claimed in claim 1, wherein:

the at least one timing detecting unit comprises two or more timing detecting units, and the sign output unit determines the sign based on the at least one of the average and the standard deviation of the transporting times detected by the two or more timing detecting units.

3. The paper wrinkle sign monitoring device as claimed in claim 2, wherein the timing detecting units are set in a front side and a rear side of a fuser unit of an electro-photographic printing apparatus that performs image formation on the printing medium.

4. The paper wrinkle sign monitoring device as claimed in claim 1, wherein:

the transporting times are the amount of time between a detection of a leading edge and a detection of a rear edge of the respective print media by the same timing detecting unit, and the sign output unit determines the sign based on the at least one of the average and the standard deviation of the transporting times detected by the same timing detecting unit.

5. The paper wrinkle sign monitoring device as claimed in claim 4, wherein the timing detecting unit is set at a rear side of a fuser unit of an electro-photographic printing apparatus that performs image formation on the printing medium.

6. The paper wrinkle sign monitoring device as claimed in claim 5, wherein the sign output unit determines the sign based on the at least one of the average and the standard deviation of the skew angle obtained for each kind of the printing media.

7. The paper wrinkle sign monitoring device as claimed in claim 5, wherein the sign output unit determines the sign based on the at least one of the average and the standard deviation of the skew angle obtained for each range of recording density of the image recorded on the printing media.

8. The paper wrinkle sign monitoring device as claimed in claim 5, wherein the sign output unit determines the sign based on the at least one of the average and the standard deviation of the skew angle obtained for each image recording mode.

9. The paper wrinkle sign monitoring device as claimed in claim 1, wherein the sign output unit determines the sign based on the at least one of the average and the standard deviation of a skew angle obtained from the transporting times detected by the at least one timing detecting unit.

10. The paper wrinkle sign monitoring device as claimed in claim 9, wherein the at least one timing detecting unit is set in at least one side of a front side and a rear side of a fuser unit of an electro-photographic printing apparatus that performs image formation on the printing medium.

11. The paper wrinkle sign monitoring device as claimed in claim 1, wherein the sign output unit determines the sign based on the at least one of the average and the standard deviation of the transporting times obtained for each kind of the printing media.

12. The paper wrinkle sign monitoring device as claimed in claim 1, wherein the sign output unit determines the sign based on the at least one of the average and the standard deviation of transporting times obtained for each range of recording density of an image recorded on the printing media.

13. The paper wrinkle sign monitoring device as claimed in claim 1, wherein the sign output unit determines the sign based on the at least one of the average and the standard deviation of the transporting times obtained for each image recording mode.

14. The paper wrinkle sign monitoring device as claimed in claim 1, wherein the first predetermined number of detected transporting times is 100.

15. The paper wrinkle sign monitoring device as claimed in claim 14, wherein the determining the sign of paper wrinkle generation is performed after a second predetermined number of images have been formed.

16. The paper wrinkle sign monitoring device as claimed in claim 15, wherein the second predetermined number of images that have been formed is 1000.

17. A paper wrinkle sign monitoring method comprising:

determining printing conditions of printing media;

detecting transporting times which are an amount of time it takes for the respective print media to be transported a specified distance;

storing the detected transporting times of the printing media;

determining a sign of a paper wrinkle generation in the transporting times of the printing media based on at least one of an average and a standard deviation of the transporting times of the printing media, the at least one of the average and the standard deviation is calculated only from the transporting times of printing media which have a printing condition that coincides with a predetermined recording; and outputting a notification of the sign determined in the determining step, wherein the at least one of the average and the standard deviation is determined based upon a first predetermined number of detected transporting times, and the detected transporting times are stored such that an oldest stored detected transporting time is overwritten when a number of stored detected transporting times exceeds the first predetermined number of detected transporting times.

18. A non-transitory computer readable medium storing a program causing a computer to execute a process for detecting a sign of the paper wrinkle generation, the process comprising:

determining printing conditions of printing media;

detecting transporting times which are an amount of time it takes for the respective print media to be transported a specified distance;

storing the detected transporting times of the printing media;

determining the sign of a paper wrinkle generation in the transporting times of the printing media based on at least one of an average and a standard deviation of the transporting times of the printing media, the at least one of the average and the standard deviation is calculated only from the transporting times of printing media which have a printing condition that coincides with a predetermined recording; and outputting a notification of the sign determined in the determining step, wherein the at least one of the average and the standard deviation is determined based upon a first predetermined number of detected transporting times, and the detected transporting times are stored such that an oldest stored detected transporting time is overwritten when a number of stored detected transporting times exceeds the first predetermined number of detected transporting times.

* * * * *